US009184018B2

(12) United States Patent
Sullivan et al.

(10) Patent No.: US 9,184,018 B2
(45) Date of Patent: Nov. 10, 2015

(54) COMPACT MAGNET DESIGN FOR HIGH-POWER MAGNETRONS

(71) Applicant: Raytheon Company, Waltham, MA (US)

(72) Inventors: Donald J. Sullivan, Los Ranchos, NM (US); Michael A. Mostrom, Cedar Crest, NM (US); Sean A. Sullivan, Los Ranchos, NM (US); Richard W. Johnson, Albuquerque, NM (US)

(73) Assignee: Raytheon Company, Waltham, MA (US)

( * ) Notice: Subject to any disclaimer, the term of this patent is extended or adjusted under 35 U.S.C. 154(b) by 27 days.

(21) Appl. No.: 14/220,078

(22) Filed: Mar. 19, 2014

(65) Prior Publication Data

US 2015/0270090 A1 Sep. 24, 2015

(51) Int. Cl.
*H01J 25/50* (2006.01)
*H01J 23/10* (2006.01)

(52) U.S. Cl.
CPC *H01J 23/10* (2013.01); *H01J 25/50* (2013.01)

(58) Field of Classification Search
CPC ..... H01J 25/50; H01J 25/587
USPC ..... 315/501, 39.51, 39.71
See application file for complete search history.

(56) References Cited

U.S. PATENT DOCUMENTS

| | | | | |
|---|---|---|---|---|
| 3,087,084 | A | 4/1963 | Kuchinsky | |
| 3,881,127 | A | 4/1975 | MacMaster et al. | |
| 6,525,477 | B2 * | 2/2003 | Small | 315/39.51 |
| 8,878,433 | B1 * | 11/2014 | Fleming et al. | 315/39.3 |

FOREIGN PATENT DOCUMENTS

FR 2 361 740 A1 3/1978

OTHER PUBLICATIONS

Notification of Transmittal of the International Search Report and the Written Opinion of the International Searching Authority, or the Declaration dated Apr. 9, 2015 in connection with International Patent Application No. PCT/US2015/011726.

* cited by examiner

*Primary Examiner* — Jimmy Vu

(57) ABSTRACT

A high-power magnetron assembly includes a high-power magnetron and a compact magnetic field generator. The high-power magnetron includes a cathode configured to emit electrons in response to receiving a supply of voltage from a power supply. The high-power magnetron includes an anode configured to concentrically surround the cathode and to attract the emitted electrons across an interaction region between the cathode and the anode. The compact magnetic field generator includes a plurality of permanent magnets including: a cathode magnet that has a longitudinal axis of symmetry annularly and that is surrounded by the cathode and disposed within the magnetron; and an anode magnet configured to annularly surround an outer perimeter of the magnetron. An arrangement of the plurality of permanent magnets concentrically about the longitudinal axis of symmetry forms a specified magnetic field within the interaction region that bounds the electrons emitted within the interaction region.

21 Claims, 8 Drawing Sheets

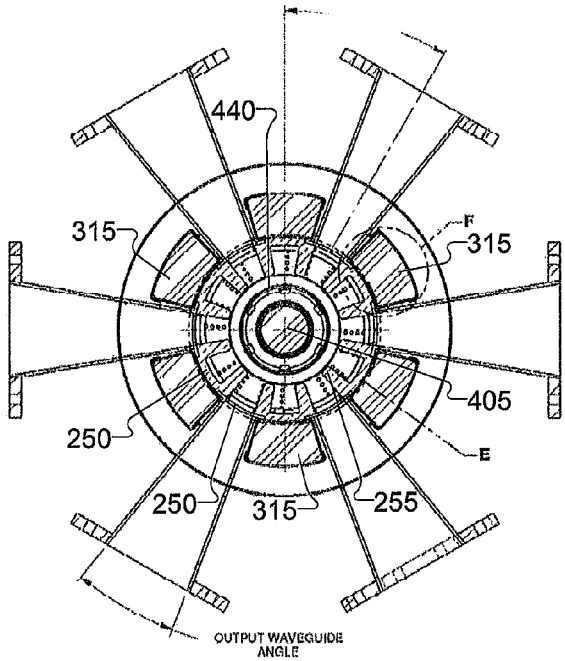
FIG. 4D
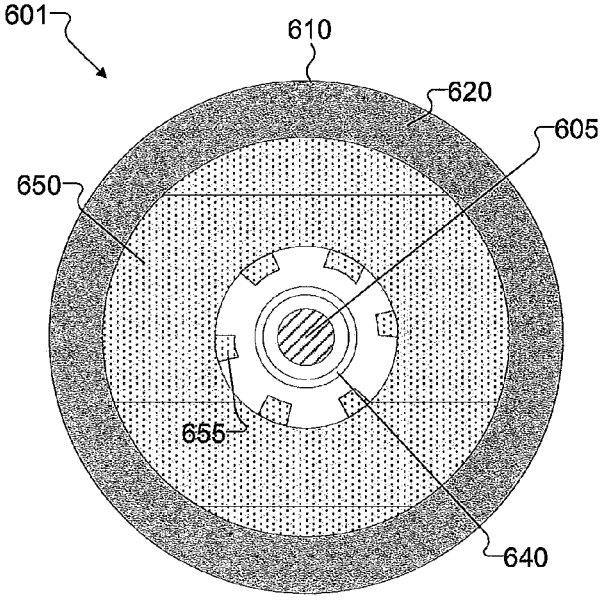
FIG. 6
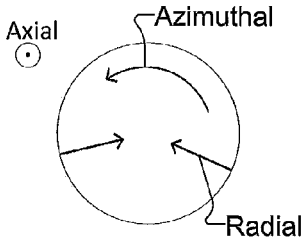
Legend of Orientation

COMPACT MAGNET DESIGN FOR HIGH-POWER MAGNETRONS

TECHNICAL FIELD

The present disclosure is directed in general to magnetrons and more specifically to a system and method for generating and shaping a nearly uniform magnetic field using a compact permanent-magnet system for use in compact high-power magnetrons.

BACKGROUND OF THE DISCLOSURE

Magnetrons require a strong and nearly uniform external magnetic field within the interaction region between the cathode and anode structures. Various magnetic-field generator solutions meet these requirements. One solution includes two "Helmholtz-like" coils or a solenoid, which can generate a nearly uniform field in a central region between the coils containing the magnetron. A second solution includes a "U-shaped" bar of iron with a coil at the bottom of the "U" and the magnetron placed between ends of the "U." A third solution applies to a low-power magnetron, where external "U-shaped" permanent magnets are used. The permanent magnets according to the third solution are relatively large and heavy because a large amount of magnetic material is necessary to create the "U-shaped" permanent magnets. Specifically, the magnetron cathode and anode (the main magnetron structures) are very small, so the permanent magnets are located external to these main magnetron structures. The permanent magnets must be relatively large and heavy in order to generate the required magnetic field in the small interior region between the cathode and anode because the permanent magnets are located at some distance from the primary electron-beam interaction region in the gap between the cathode and anode.

Both of the magnetic-field generator techniques described above that use coils to generate the magnetic field required for high-powered magnetrons are large and heavy and require an external power source for the coils. The volume and weight associated with the power source adds additional size and weight to the magnetic-field generator/magnetron system. High-power magnetrons that have a high duty factor operation may require a method of cooling the magnet coils. A cooling system for the magnet coil adds additional size and weight to the magnetron. Many potential applications for a magnetron cannot tolerate the weight or size of these magnetic-field generator techniques.

SUMMARY OF THE DISCLOSURE

To address one or more of the above-deficiencies, embodiments described in this disclosure provide a compact high-power magnetron assembly.

A compact high-power magnetron assembly includes a high-power magnetron and a compact magnetic field generator. The high-power magnetron includes a cathode configured to emit electrons in response to receiving a supply of voltage from a power supply. The high-power magnetron includes an anode configured to concentrically surround the cathode and to attract the emitted electrons across an interaction region between the cathode and the anode. The compact magnetic field generator includes a plurality of permanent magnets including: a cathode magnet that has a longitudinal axis of symmetry and that is surrounded by the cathode and disposed within the magnetron; and an anode magnet configured to annularly surround an outer perimeter of the magnetron. An arrangement of the plurality of permanent magnets concentrically about the longitudinal axis of symmetry forms a specified magnetic field within the interaction region that bounds the electrons emitted within the interaction region.

Certain embodiments may provide various technical advantages depending on the implementation. For example, a technical advantage of some embodiments may include the capability to provide a light weight magnetron assembly. Another technical advantage involves the ability to arrange the permanent magnets in such a way as to provide magnetic field shaping that reduces axial loss currents. A technical advantage includes the capability to perform high repetition rate operation without needing to cool magnet coils. Another technical advantage may include the ability to receive high currents through a long interaction region without longitudinal overmoding by magnetically bounding axial ends of the interaction region. A technical advantage of certain embodiments is axial insulation.

Although specific advantages have been enumerated above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 4D illustrates a lateral cross section of a portion of the compact high-power magnetron assembly of FIG. 4A with the back ring magnet removed for illustration purposes;

FIG. 6 illustrates a front view of a compact magnetic field generator for high-power magnetrons, according to an embodiment of the present disclosure.

DETAILED DESCRIPTION

It should be understood at the outset that, although example embodiments are illustrated below, the present invention may be implemented using any number of techniques, whether currently known or not. The present invention should in no way be limited to the example implementations, drawings, and techniques illustrated below. Additionally, the drawings are not necessarily drawn to scale.

According to embodiments of the present disclosure, the magnetic field required for a high-power (e.g., at least 10 megawatts) microwave source is produced by a magnetic field generator that includes only permanent magnets. As a non-limiting example, the magnetic field generator according to embodiments of this disclosure can generate a magnetic field required for a high-power microwave source of 10 megawatts or more. The desired magnetic field is generated over the entire required volume. The magnetic field generated is nearly uniform, and the magnetic field profile is adjustable to better optimize the magnetron performance. Embodiments of the present disclosure do not require external source of power for the magnets, and consequently, no extra cooling device for the magnetic field generator is required. The magnets are arranged in a manner that reduces the size and weight of the magnetron. In particular, a permanent magnet is placed within the cathode, and other magnets may also be placed within the vacuum vessel above and below the interaction region as appropriate. Because the magnetic field caused by a permanent magnet decreases with distance from the permanent magnet, disposing the magnets as close as possible to the interaction region (i.e., by placing a magnet within the cathode) results in a reduction of the amount of magnetic material necessary to generate a particular magnetic flux density, and, therefore, results in a reduction of system weight and volume.

Figure 1:
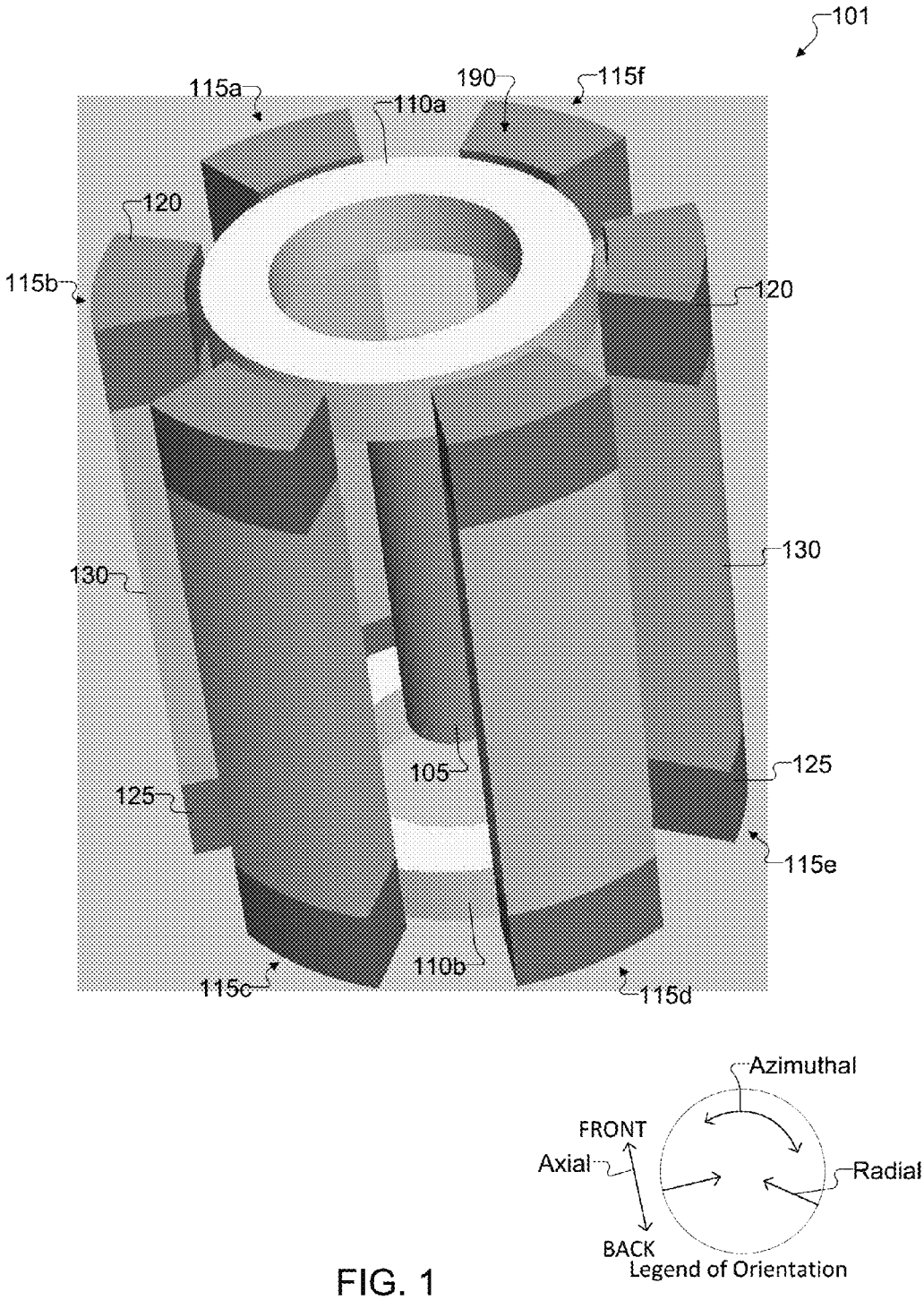
FIG. 1 illustrates a compact magnetic field generator for high-power magnetrons, according to embodiments of the present disclosure.

FIG. 1 illustrates a compact magnetic field generator for high-power magnetrons according to an embodiment of the present disclosure. Although certain details will be provided with reference to the components of the magnetic field generator 101 of FIG. 1, it should be understood that other embodiments may include more, less, or different components.

The compact magnetic field generator 101 for high-power magnetrons includes multiple permanent magnets: a cathode magnet 105, a front ring magnet 110*a*, a back ring magnet 110*b*, and an anode magnet assembly that includes multiple annular wedge magnets 115*a-f*. Each of the annular wedge magnets 115*a-f* includes an anode magnet 130 and end caps 120, 125 at each respective end of the anode magnet 130. As a particular example with reference to the legend of orientation shown, the annular-wedge magnet 115*e* includes an anode magnet 130, a front end cap 120, and a back end cap 125.

The magnetron includes two main structures, namely, a cathode and an anode, within the vacuum vessel of the magnetron. The cathode emits electrons. Around the cathode is a concentric cylinder anode structure that has vanes that protrude in, like spokes on a wheel, but the vanes do not contact the cathode. Anode structures can include six vanes, twelve vanes, or other quantities of vanes. A resonant cavity is formed between two adjacent vanes. The resonant cavity can take many different forms, such as vane-type, hole-and-slot-type, and the like. When a voltage is applied between the cathode and anode, the cathode emits electrons that spiral around the cathode in the applied magnetic field, which allows the electrons to interact with an EM wave that is propagating around the anode. Certain ones of the electrons have a trajectory characterized by a phase relative to the RF wave that causes the electrons to accelerate and bend in the applied magnetic field, such that those electrons return to the cathode. Certain ones of the electrons have a trajectory characterized by a phase relative to the RF wave that causes the electrons to decelerate and slowly lose energy to the RF fields, which allows the decelerated electrons to migrate to the anode and be collected. Thus, energy from the electrons is converted to RF energy, which is then extracted from the magnetron. The RF energy can be extracted by a waveguide or other means. As a technical advantage, embodiments of present disclosure produce a required magnetic field in a small volume, light weight magnetron.

In FIG. 1, the magnetron is hidden, but the cathode magnet 105 is a central cylindrical, rod-shaped permanent magnet embedded in the cathode of the magnetron. The cathode magnet 105 is axially symmetric. The cathode magnet 105 is centered along the longitudinal axis of symmetry of the compact magnetic field generator 101. The cathode magnet 105, the front ring magnet 110*a*, and the back ring magnet 110*b* are disposed inside of the magnetron. The cathode magnet 105 is inside of the cathode of the magnetron. That is, the cathode is disposed around the cathode magnet 105. In certain embodiments, the cathode fits around the cathode magnet 105 as a sleeve.

The axial position of the front and back ring magnets 110*a* and 110*b*, respectively, affects the intensity of the magnetic-field. An adjustment of the axial position of either or both of the front and back ring magnets 110*a* and 110*b* by a small amount (for example, ±0.5 centimeters) correspondingly adjusts the intensity of the magnetic-field. That is, the front ring magnet 110*a* is adjusted further or closer to the front surface of the anode magnet assembly (e.g., the front surface of the anode magnet 130 or the front surface of the front end cap 120) to adjust the intensity of the magnetic-field by a small amount near the front of the interaction region. The back ring magnet 110*b* is adjusted further or closer to the back surface of the anode magnet assembly (e.g., the back surface of the anode magnet 130 or the back surface of the back end cap 125) to adjust the intensity of the magnetic-field by a small amount near the back of the interaction region. The front and back ring magnets 110*a* and 110*b* can also be referred to as trimming magnets. The front ring magnet 110*a* is disposed at an axial level between the front surface (shown towards the top of FIG. 1) of the cathode magnet 105 and the front surface 190 of the front end caps 120. The back ring magnet 110*b* is disposed at an axial level between the back surface (shown towards the bottom of FIG. 1) of the cathode magnet 105 and the back surface of the back end caps 125.

The interaction region is disposed between a front Z-axis coordinate marginally in front of the front surface of the front ring magnet 110*a* and a back Z-axis coordinate marginally behind the back surface of the back ring magnet 110*b*.

The ring magnets 110*a-b* partially serve a similar purpose as the end cap magnets (described more particularly below). By adjusting or selecting the amount of magnetic material in these ring magnets 110*a-b* and the orientation of their magnetic fields, the ring magnets 110*a-b* effectively bend the magnetic field lines from the primary and end-cap anode magnets to further adjust the magnitude and uniformity of the axial magnetic field in the interaction region. The ring magnets 110*a-b* also provide additional control of the radial component of the magnetic field at the ends of the interaction region. They provide an additional feature that the end cap magnets 120, 125 do not provide: the ring magnets 110*a-b* are movable and so allow an experimenter a way to slightly adjust or tune the magnetic field after the compact high-power magnetron assembly is built and installed, possibly to account for manufacturing tolerances. Certain embodiments of the present disclosure do not include ring magnets. Embodiments that include ring magnets 110*a-b* offer additional flexibility in designing and tuning the magnetic field to optimally meet the detailed goals set by the magnetron designer.

The anode magnet assembly is disposed external to the magnetron vacuum vessel, such that the inner circumferential surface of the annular wedge magnets 115*a-f* is in direct physical contact (namely, no intermediate components) with the outer surface of the cylindrical magnetron anode. The example shown in FIG. 1 includes six annular wedge magnets, but other embodiments can include more or fewer annular wedge magnets around the magnetron. The length of each anode magnet 130 is marginally longer than the length of the interaction region (i.e., the set of Z-coordinates in which the electron beam will interact with the anode). The anode magnet assembly generates the majority of the magnetic flux within the interaction region because the anode magnet assembly has the largest volume of magnetic material in the device.

Because the anode magnets (for example, reference 605 of FIG. 6 or the anode magnet assembly) have the most magnetic material, because the anode magnets can be much larger than the cathode magnet 105, the anode magnets control most of the amplitude and uniformity of the axial magnetic field in the interaction region. Because the cathode magnet 105 is so close to the interaction region, the cathode magnet 105 can provide additional control over the amplitude and details of the uniformity of the axial magnetic field in the interaction region. The cathode magnet 105 also generates a radial component of the magnetic field at each axial end of the interaction region. The radial component generated by the cathode magnet 105 can be useful in assisting the confinement of the electrons to the interaction region, especially considering that additional control of this radial magnetic field can be provided by additional magnets such as the ring magnets 110. The cathode magnet 105 is not required, but does offer desirable flexibility in designing and tuning the magnetic field from the anode magnets to optimally meet the detailed goals set by the magnetron designer.

The end caps 120, 125, in collaboration with the magnetic field of the anode magnet 130, boost the strength of the magnetic field in the interaction region and reduce the amount of magnetic flux that extends outside the magnetron. The orientation of the magnetic field (also referred to as magnetization) of the end caps 120, 125 is different (for example, anti-parallel, perpendicular, or angled) from the orientation of the magnetic field of the anode magnet 130 to which the end caps 120, 125 are physically coupled. The end caps 120, 125 effectively focus the magnetic field toward the interaction region. The end caps 120, 125 direct and confine the majority of the magnetic flux generated by the anode magnet 130 to the interaction region, and consequently prevents magnet flux from leaking out to the exterior of the magnetron and prevents magnet flux from leaking out to Z-coordinates outside the interaction region. In certain embodiments, the anode magnet assembly does not include any end caps 120, 125.

By selecting or adjusting the amount of magnetic material in these end caps 120, 125 and the orientation of their magnetic fields, the end caps 120, 125 can effectively bend the magnetic field lines from the primary anode magnets to further adjust the magnitude and uniformity of the axial magnetic field in the interaction region. Certain embodiments of the magnetic field generator 101 do not include end caps. Embodiments that include end caps 120, 125 offer additional flexibility in designing the magnetic field to optimally meet the magnetic-field amplitude and uniformity goal set by the magnetron designer.

The permanent magnets, namely, the cathode magnet 105, the front ring magnet 110*a*, the back ring magnet 110*b*, the end caps 120 and 125, and the anode magnet 130, may be composed from a permanent magnetic material, such as neodymium iron boron ($Nd_2Fe_{14}B$) or others.

Figure 2:
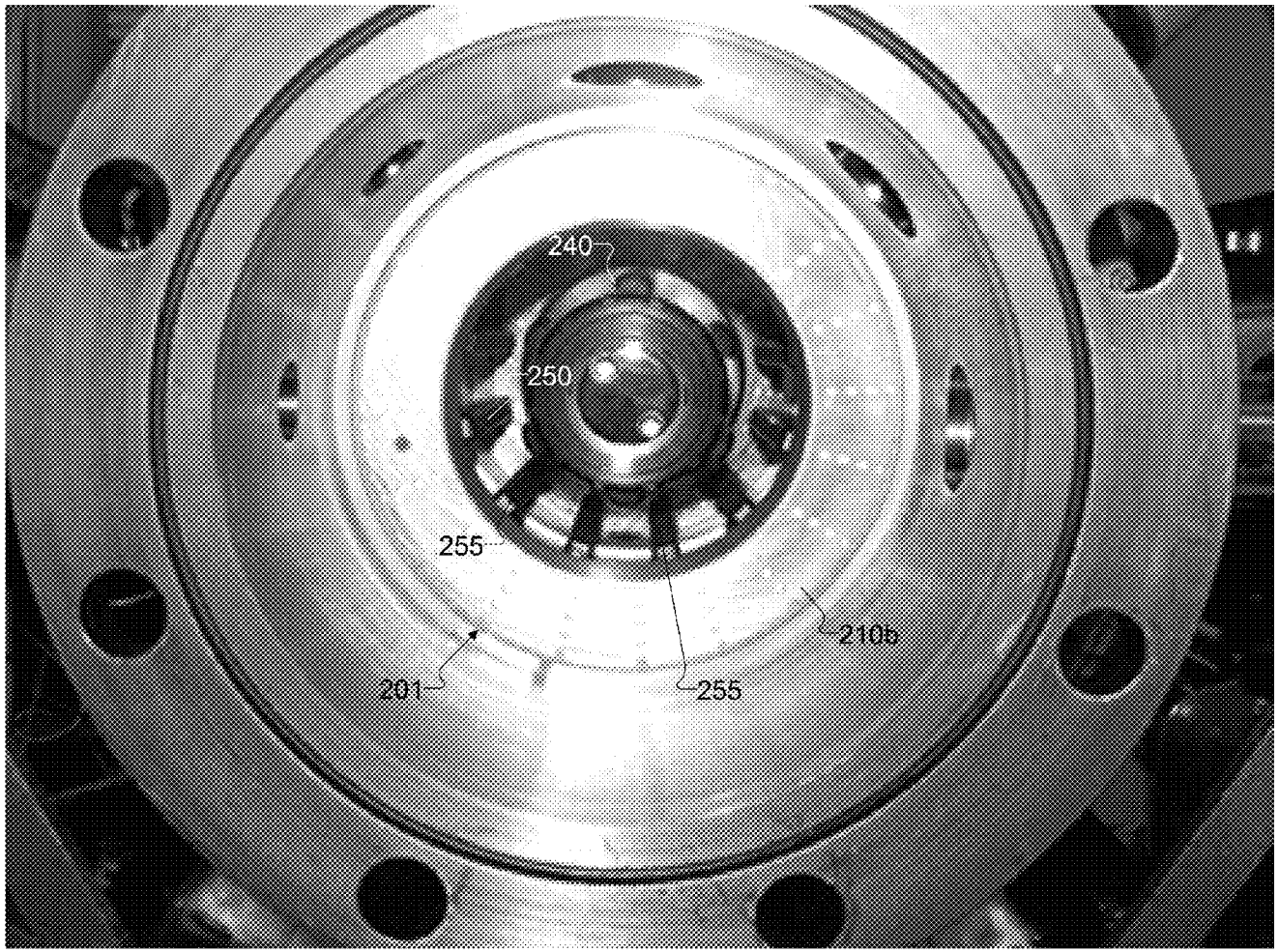
FIGS. 2, 3, and 4A illustrate a magnetron assembly, according to embodiments of the present disclosure.
Figure 4A:
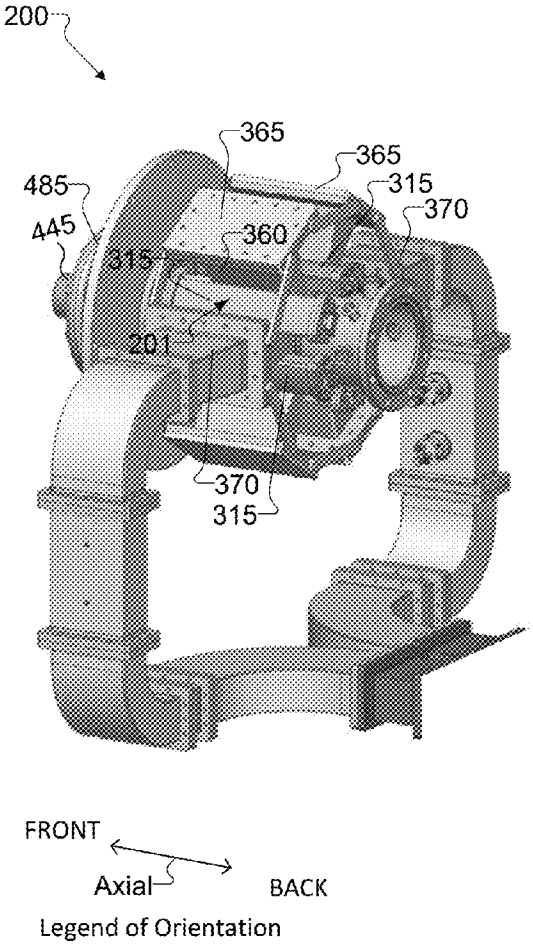
Figure 3:
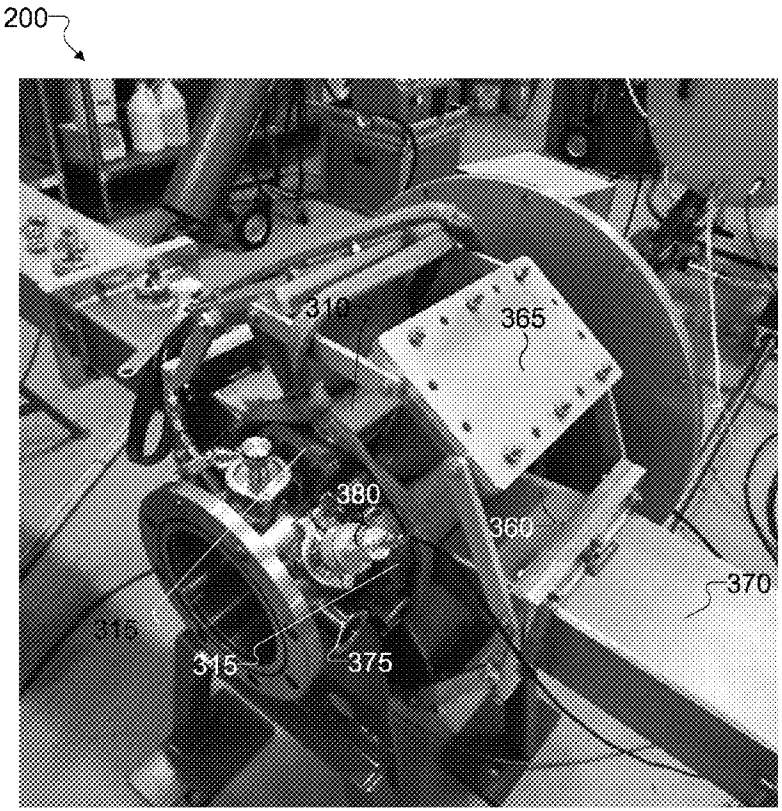

FIGS. 2, 3, and 4A-4D illustrate a magnetron assembly according to an embodiment of the present disclosure. Although certain details will be provided with reference to the components of the magnetron assembly 200 of FIGS. 2, 3 and 4A-4D, it should be understood that other embodiments may include more, less, or different components. FIG. 2 illustrates a back view of a portion of the magnetron assembly 200. FIG. 3 illustrates an isometric view from the top and back of the whole compact magnetron assembly 200. FIG. 4A illustrates a three-dimensional (3D) model isometric view of the magnetron assembly 200.

The magnetron assembly 200 includes a compact magnetic field generator 201 for high-power magnetrons, a high-power magnetron (internal within the magnetron assembly), and multiple waveguides. The waveguides are not visible in FIG. 2, but are shown in FIG. 3.

The high-power magnetron includes two main structures, namely, a cathode 240 and an anode 250, both within the vacuum vessel of the high-power magnetron. The cathode 240 receives a supply of negative voltage through input terminals (not shown) coupled to a voltage supply or pulsed power system. The cathode 240 includes the input terminals, and in response to receiving the negative voltage, emits electrons radially outward. That is, the cathode 240 emits electrons when a voltage is applied between the anode 250 and the cathode 240, such that the cathode has a lower potential (for example, is at a negative voltage) with respect to the anode. The electron emitting surface of the cathode may be made of various materials, including graphite, velvet, carbon fiber, and the like.

The anode 250 encircles the cathode 240. The anode includes a slow-wave structure (SWS) that reduces the phase velocity of an electromagnetic wave propagating along the SWS to allow for effective interaction with the electron cloud, arranged oppositely to the cathode 240 such that electrons from the cathode 240 are emitted into the region between the cathode surface and the SWS. The region between the cathode surface and the SWS can also be referred to as the anode-cathode gap. The anode 250 is a concentric cylinder that has vanes 255 that protrude radially inward, towards the cathode 240, like spokes on a wheel, but the vanes 255 do not physically contact the cathode 240. The anode 250 is composed from an electrically conductive material, such as copper. When a voltage is applied between the cathode and anode, the cathode 240 emits electrons that spiral around the cathode in the applied magnetic field. The spiraling electrons interact with an EM wave that propagates along the slow wave structure formed by the vanes 255 in the anode 250. Certain ones of the electrons have a trajectory characterized by a phase relative to the RF wave that causes the electrons to accelerate and bend in the applied magnetic field, such that those electrons return to the cathode. Certain ones of the electrons have a trajectory characterized by a phase relative to the RF wave that causes the electrons to decelerate and slowly lose energy to the RF fields, which cause the decelerated electrons to migrate to the anode and be collected. Thus, energy from the electrons is converted to RF energy, which is then extracted from the magnetron.

Note that while two compact magnetic field generators 101 and 201 are shown here, features of one compact magnetic field generator could be used in the other compact magnetic field generator. For instance, the compact magnetic field generator 201 can include a back ring magnet 210*b* (similar to or the same as the back ring magnet 110*b*) in the back of the compact magnetic field generator 201. Note also that the compact magnetic field generator 101 is similar to the compact magnetic field generator 201 such that like reference numerals correspond to or represent like parts. For example, the compact magnetic field generator 101 includes component 110*b*, which may be similar to component 210*b* of FIG.

2, and the compact magnetic field generator 101 includes components 115*a-f* which may be similar to the component 315 of FIGS. 3 and 4A, 4B, and 4D.

As shown in FIG. 3, the complete compact high-power magnetron assembly 200 includes a compact magnetic field generator 201, a high-power magnetron (including the cathode 240 and the anode 250 internally within the complete compact magnetron assembly 200), and multiple output waveguides 360. One or more wedge shaped waveguides 360 are coupled to the high-power magnetron. Each waveguide 360 fits between to two annular wedge magnets 315 (e.g., annular wedge magnets 115*a-f*) and attaches to extraction port openings in the outer surface of the anode between the vanes. Each waveguide 360 is also mechanically coupled to an RF extraction waveguide 370 or is terminated in an end plate 365 to seal off the vacuum inside the magnetron. In the example shown in FIG. 3, the magnetron assembly 200 includes six waveguides 360, with two of the waveguides 360 respectively coupled to an extraction waveguide 370 and the other four waveguides 360 terminated in end plates 365. In various embodiments of the magnetron assembly 200, more or fewer waveguides 360 are coupled to an extraction waveguide 370. For example, each of the waveguides 360 can be coupled to an extraction waveguide 370, for a total of six extraction waveguides 370; or none of the waveguides 360 are coupled to an extraction waveguide 370 and the RF power is extracted axially. The use of six potential waveguides is just an example based on our example of six anode resonant cavities where RF extraction may be desired. A different number of waveguides (e.g., zero or two) can be used without departing from the scope of this disclosure.

FIG. 4A illustrates a three-dimensional (3D) model isometric view of the magnetron assembly 200. The magnetron assembly 200 includes a compact magnetic field generator 201 for high-power magnetrons, a high-power magnetron (internal within the magnetron assembly 200), and multiple output waveguides 360. One or more wedge shaped output waveguides 360 are coupled to the compact magnetic field generator 201. Each output waveguide 360 fits between two annular wedge magnets 315, and each waveguide 360 is mechanically coupled to an RF extraction waveguide 370 or to a termination plate 365. In the example shown in FIG. 4, the magnetron assembly 200 includes two output waveguides 360 and two extraction waveguides 370. In various embodiments of the magnetron assembly 200, more or fewer output waveguides 360 are coupled to an extraction waveguide 370. For example, each of the output waveguides 360 can be coupled to an extraction waveguide 370, for a total of six extraction waveguide 370; or none of the output waveguides 360 are coupled to an extraction waveguide 370.

The magnetron assembly 200 includes a connection point 445 to the pulsed power system. The connection point 445 is electrically coupled to the cathode stalk 445 that is coupled between the voltage supply and the input terminals of the cathode. The cathode stalk 445 can be a cylindrical shaped rod that shares an axis of symmetry with the cathode and cathode magnet 105. During operation, the voltage supply applies a voltage between the anode and the cathode.

The magnetron assembly 200 includes an insulator stack 485 that also shares a longitudinal axis of symmetry with the cathode and cathode magnet 105. The insulator stack 485 provides electrical insulation between cathode stalk 445 and the anode, electrically isolating the cathode from the anode. That is, when the voltage supply provides power to the cathode stalk 445, a negative voltage is applied to the cathode, which ejects electrons into the interaction space. The ejected electrons are attracted to the anode according to a radial trajectory (specifically, the ejected electrons are attracted from cathode to anode in a straight line across the interaction space). However, the magnetic field in the interaction region bends the trajectory of the ejected electrons and causes the ejected electrons to orbit or spiral around the cathode azimuthally in the interaction space. The potential energy and orbital kinetic energy of the orbiting electrons is converted to RF energy. The compact magnetic field generator 201 generates a precisely controlled magnetic field in the interaction region to establish the interaction within the interaction region and to prevent the ejected electrons from escaping the spiral motion of interaction region into the anode (specifically, preventing the ejected electrons from reaching the anode without the assistance of the RF field). That is, the permanent magnets of the compact magnetic field generator 201 interact with each other to control the shape, polarity, and intensity of the magnetic field within the interaction region.

Figure 4B:
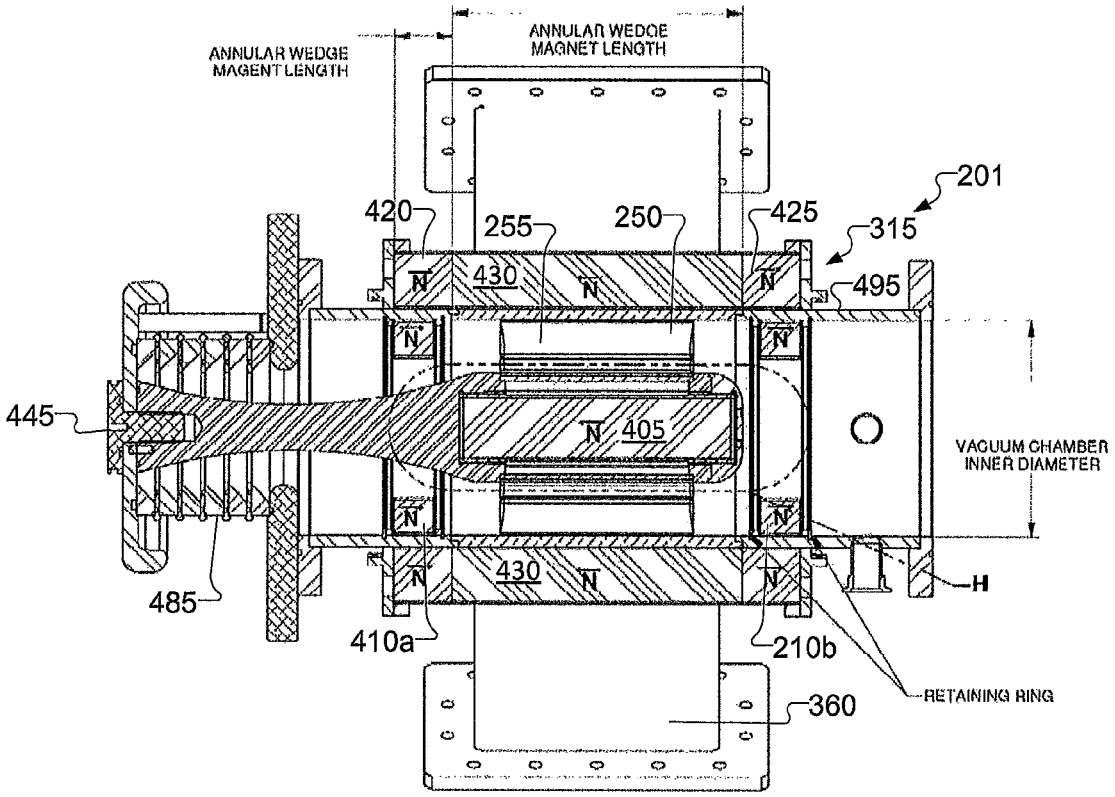
FIG. 4B illustrates an axial cross section of the compact high-power magnetron assembly of FIG. 4A.
Figure 4C:
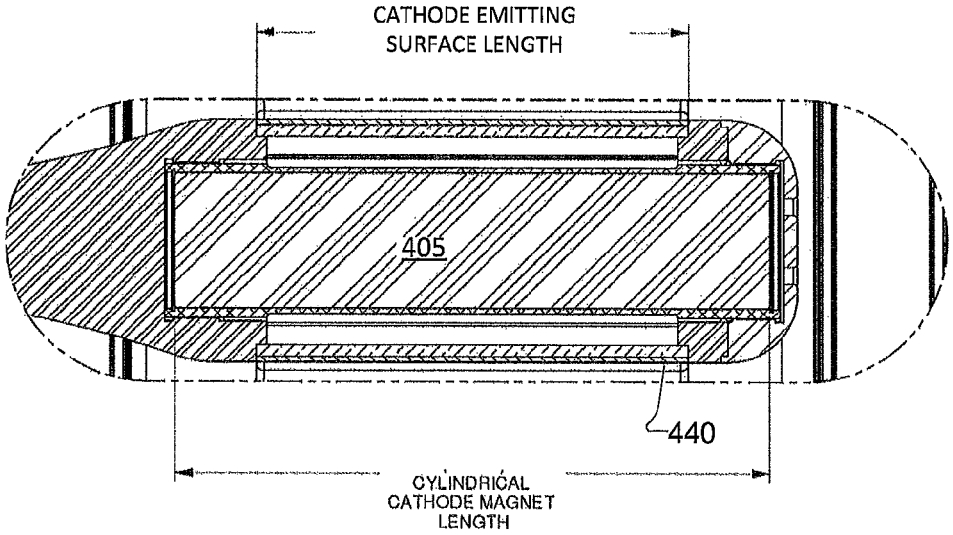
FIG. 4C illustrates an axial cross section of the magnetron's cathode of FIG. 4B with its embedded permanent magnet.

FIG. 4B illustrates an axial cross section of the compact high-power magnetron assembly 200 of FIG. 4A. FIG. 4C illustrates an axial cross section of the magnetron's cathode of FIG. 4B with its embedded permanent magnet. FIG. 4C shows more particular details of the cathode assembly of FIG. 4B. As shown in FIGS. 4B and 4C, magnetron assembly 200 includes a compact magnetic field generator 201, a high power magnetron (including a cathode 240 and an anode 250), a connection point 445 to the cathode stalk, output wave guides 360, and an insulator stack 485. The anode 250 includes anode vanes 255. The magnetic field generator 201 includes a cathode magnet 405, a front ring magnet 410*a*, a back ring magnet 210, and annular wedge magnets 315 (each including a front end cap 420, back end cap 425, and an anode magnet 430).

The cathode magnet 405, cathode 240, anode 250, ring magnets 310*a-b*, and the anode magnet assembly are concentrically centered about the longitudinal axis of symmetry. The cathode magnet 405, at the center, is surrounded by a cathode 240. The inner circumference of the vanes 445 of the anode 250 is disposed in close proximity to the cathode 240. The ring magnet (i.e., either or both of the front and back ring magnets 410*a* and 210*b*) is disposed between the inner circumference and outer circumference of the vanes 255 of the anode 250. In certain embodiments, the outer circumference of the vanes 255 of the anode 250 is disposed equally as far away from the center as the outer circumference of the ring magnet 310. The anode 250 is disposed axially between the two ring magnets 410*a* and 210*b*. The remainder of the cylindrical block of the anode 250 is disposed between the outer circumference of the anode vanes 255 and the inner surface of the magnetron vacuum vessel (also referred to as vacuum chamber). That is, the cathode magnet 405, the cathode 240, the ring magnets 410*a* and 210*b*, and the anode 250 are disposed inside the magnetron vacuum vessel 495. The annular wedge magnets 315 of the anode magnet assembly are coupled to the exterior surface of the magnetron vacuum vessel 495.

FIG. 4D illustrates a lateral cross section of a portion of the compact high-power magnetron assembly of FIG. 4A with the back ring magnet 210*b* removed for illustration purposes. As shown in FIG. 4D, the location of the ring magnet 310 is within the dashed line E. It is possible for a person to see portions of the back surface of the front ring magnet 410*a* when the person looks through the back of the compact high-power magnetron assembly of FIG. 4A while the back ring magnet 210*b* is removed. The location of the annular wedge magnets 315 is outside of the dashed line E, and the location of an annular wedge magnet 315 is within the dashed line F.

In certain embodiments, the compact magnetic field generator 200 does not include a front ring magnet 110*a*.

Figure 5:
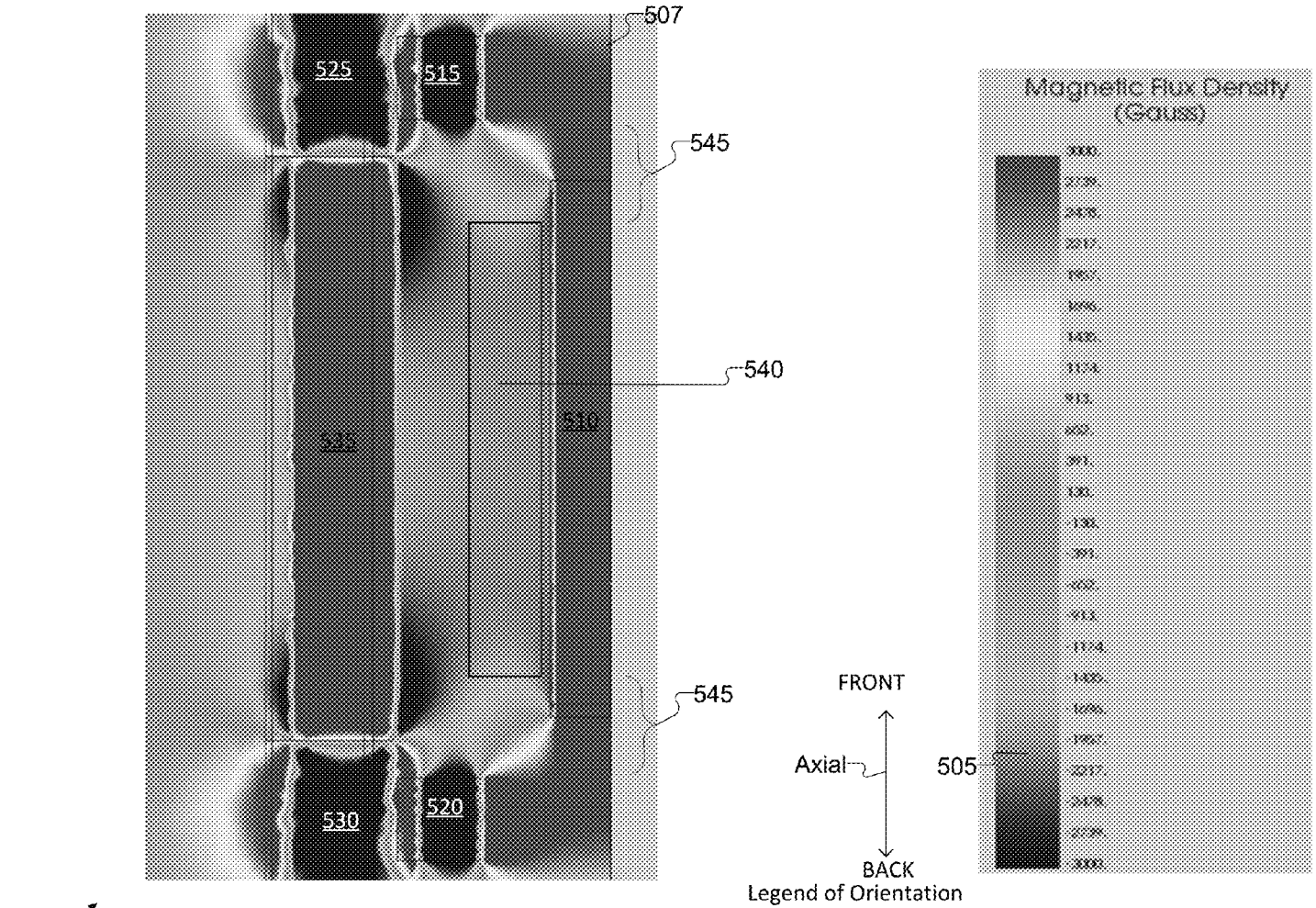
FIG. 5 illustrates simulation results of magnetic flux density of a compact magnetic field generator for high-power magnetrons, according to embodiments of the present disclosure.

FIG. 5 illustrates simulated results 500 of magnetic flux density of a compact magnetic field generator for high-power magnetrons according to an embodiment of the present disclosure. The measured results 500 can be read according to the legend of magnetic flux density varying within the range of 3000 Gauss to −3000 Gauss and the legend of orientation.

As a specific and non-limiting example, the compact magnetic field generator 201 was used to generate target 505 magnetic field near the cathode having an absolute value of 2 kilogauss (2 kG) (that is, $B_z \approx 2$ kG). As an outcome, the magnetic flux density results 500 are shown as simulation results through a cross-section of half of the compact magnetic field generator 100, where the axis of symmetry 507 of the compact magnetic field generator 201 is through the center of the cathode magnet 105. The center of the cathode magnet 105 is also the center of the cathode. That is, the magnetic flux density through the center of the cathode magnet 105 was 3000 Gauss or more, as shown by the magnetic flux density results area 510. The magnetic flux density through the front and back ring magnets 110*a* and 110*b* was −3000 Gauss or more, as shown by the corresponding magnetic flux density results areas 515 and 520, respectively. The magnetic flux density through the a front and back end cap magnets 120, 125 was −3000 Gauss or more, as shown by the corresponding magnetic flux density results areas 525 and 530, respectively. The magnetic flux density through the anode magnet 130 was 3000 Gauss or more, as shown by the corresponding magnetic flux density results area 535. The magnetic flux density through the various magnets was well above 3000 Gauss, but the scale for the figure was selected in order to show the finer details of the magnetic field. That is, the maximum and minimum of the color scale was chosen in a way that it is not possible to determine from the figure what the magnetic flux density of areas that are colored deep blue or deep red actually was. More particularly, FIG. 5 does not show an amount of magnetic flux density above or below ±3000 Gauss that was generated in the areas of the deep blue or deep red. The magnetic flux density through the interaction region was approximately −2 kG, as shown by the corresponding magnetic flux density results area 540.

As shown, the small magnets used within the compact magnetic field generator 201 provides excellent control of the magnetic field within the magnetic flux density results area 540, which can be referred to as the interaction region, itself. The $B_Z$ component of the magnetic field in the interaction region 540 is substantially uniform throughout the length of the interaction region 540.

In this disclosure, the power source drives high current through the magnetron, and the electrons flowing down the cathode stalk create an azimuthal magnetic field that bends the ejected electrons' trajectories so that the electrons have an axial component of velocity. This axial velocity can lead to an axial leakage current, which decreases the power efficiency of the magnetron. Additionally, the axial component of electron velocity can lead to a distortion of the space-charge cloud such that the space-charge cloud is not axially symmetric about the axial center of the cathode's emitting surface. Such a distortion of the space-charge cloud can lead to longitudinal overmoding when the length of the anode vanes is greater than half a wavelength. Longitudinal overmoding is a serious problem that can result in the premature termination of the RF output from a magnetron. The length restriction enforced by longitudinal overmoding considerations serves to place a lower limit on the impedance of the magnetron since the emitting area of the cathode is directly proportional to its length, and the radius of the cathode will be constrained by other considerations, such as diameter of the anode. The multiple permanent magnets 105, 110*a-b*, 120, 125, and 130 of the compact magnetic field generator 100 define the shape of the magnetic field. The cathode magnet 105 provides a radial component of the magnetic field at the axial ends of the interaction region. This small radial component of the magnetic field (shown in FIG. 7) serves to provide a Lorentz force that causes electrons at the axial ends of the interaction region to bend back towards the center of the interaction region. As such, the radial component of the magnetic field eliminates axial leakage currents, and prevents axial distortion of the space-charge clouds at high currents, thus eliminating longitudinal overmoding of the anode as a consideration in the length of the magnetron. When the cathode magnet 105 is placed within the cathode (i.e., in the middle of the space-charge cloud), the radial component of the magnetic field can have the correct direction to provide axial insulation. However, when designing the shape of the magnetic field, the interaction between the cathode magnets 105 and other magnets in the system becomes very important (when a decision is made to include a cathode magnet in the magnetic field generator). In particular, it is important to utilize the field from the anode magnets and ring magnets to decrease the radial component of the magnetic field from the cathode magnet 105 because, if the radial component of the magnetic field from the cathode magnet 105 is too large, the field will not only provide axial insulation of the electron cloud, but will excessively accelerate the electrons in the opposite axial direction. This acceleration will result in a loss of magnetron efficiency since the electrons' energy will have been converted into motion that is oriented such that the electrons' energy cannot be used for interaction with the anode. In summary, magnetrons according to embodiments of the present disclosure can be tens of percent longer and significantly more efficient than other magnetrons without a cathode magnet 105 and other interacting permanent magnets 110*a-b*, 120, 125, and 130.

Compared with other magnetrons, such as magnetrons having an interaction region that is ½ wavelength (½λ), the compact magnetic field generators according to embodiments of the present disclosure have an interaction region that is nearly one full wavelength (1λ). Other magnetrons are subject to a limitation on the length of the magnetron because if the magnetron is too long, then the magnetron will undergo longitudinal overmoding (also referred to as longitudinal multimoding).

FIG. 6 illustrates a front view of a compact magnetic field generator 601 for high-power magnetrons according to an embodiment of the present disclosure. Although certain details will be provided with reference to the components of the magnetic field generator 601 of FIG. 6, it should be understood that other embodiments may include more, less, or different components.

Note that while another compact magnetic field generator 601 (in addition to magnetic field generators 101 and 201) is shown here, features of one compact magnetic field generator could be used in the other compact magnetic field generator. For instance, the compact magnetic field generator 601 can include a back ring magnet 610 (similar to or the same as the back ring magnet 110*b* or 210*b*) in the back of the compact magnetic field generator 601. Note also that the compact magnetic field generator 601 includes components 605, 610, 620, 640, 650, and 655 which may be similar to components 105, 115*a-f*, and 120 of FIG. 1 and components 240, 250, and 255 of FIG. 2, respectively.

The anode magnet assembly includes a single annular magnet 610 that has a longitudinal axis of symmetry at the center of the cathode magnet 605. The annular magnet 610 includes an anode magnet, and an end cap 620 physically coupled at each end of the anode magnet. More particularly, the annular magnet 610 includes an anode magnet, a front end cap 620, and a back end cap 620. Each of the anode magnets, the front end cap 620, and the back end cap 620 is a solid magnet block comprising a hollow cylinder shape concentric with the cathode magnet. Each end cap 620 has the same inner circumference and same outer circumference as the anode magnet. That is each end cap 620 has a same cross sectional size, shape, and alignment as the anode magnet. The entire front end cap 620 is disposed axially in front of the cathode magnet 605, and the entire back end back 620 is disposed axially behind the cathode magnet 605. The compact magnetic field generator 601 is not coupled to a wedge shaped waveguide 330, an extraction waveguide 340, or a waveguide termination plate 335. In this case, RF power is extracted axially, and there is no need to provide azimuthal gaps between the annular-wedge magnets 115*a-f* to allow access for extraction waveguides, and ring magnets 110 are not included to allow for the axial extraction in the location where the ring magnets 110 would be disposed.

Figure 7:
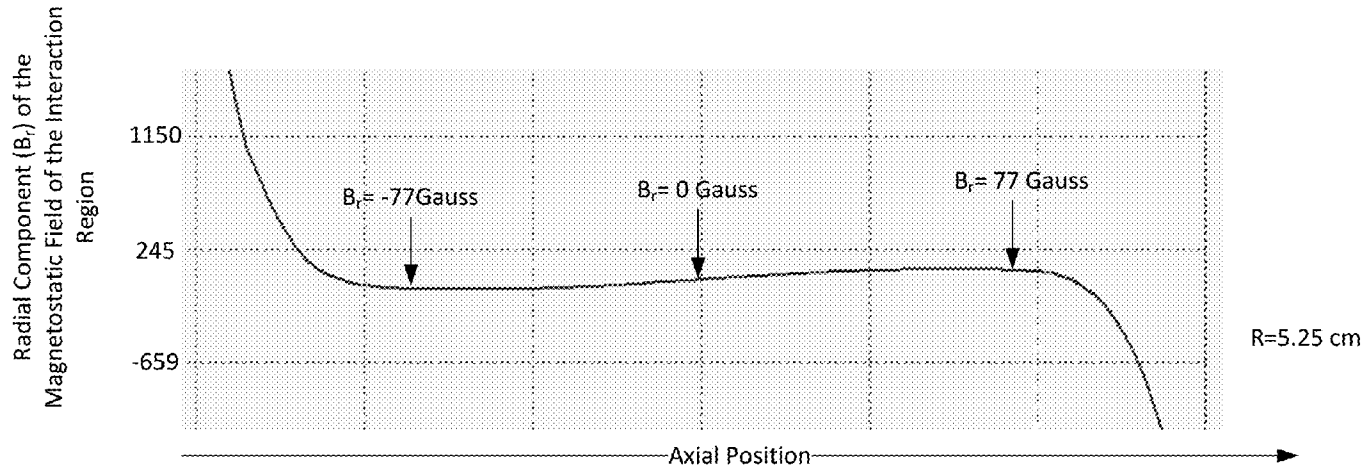
FIGS. 7-10 illustrate results of a magnetic flux density simulation of a compact magnetic field generator for high-power magnetrons, according to embodiments of the present disclosure.
Figure 8:
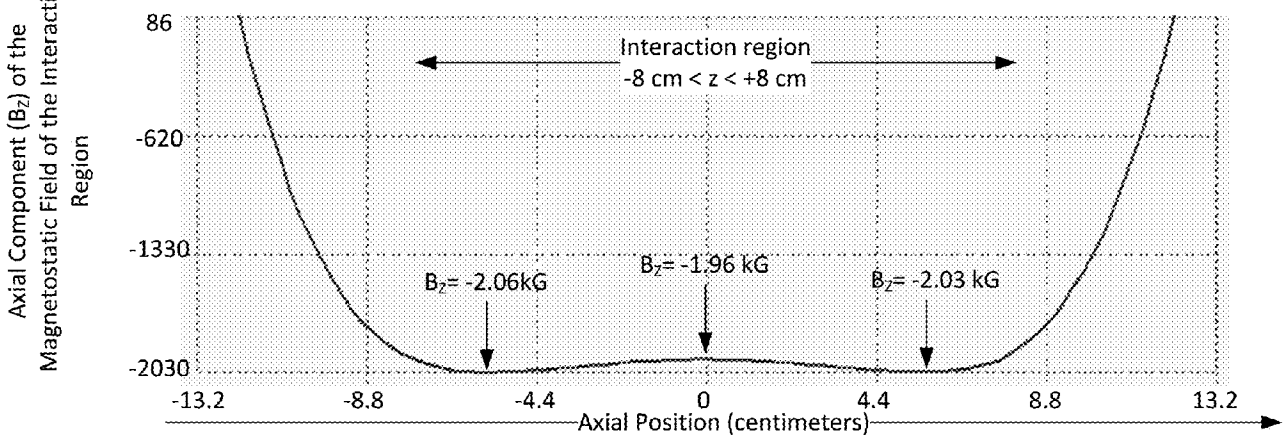
Figure 9:
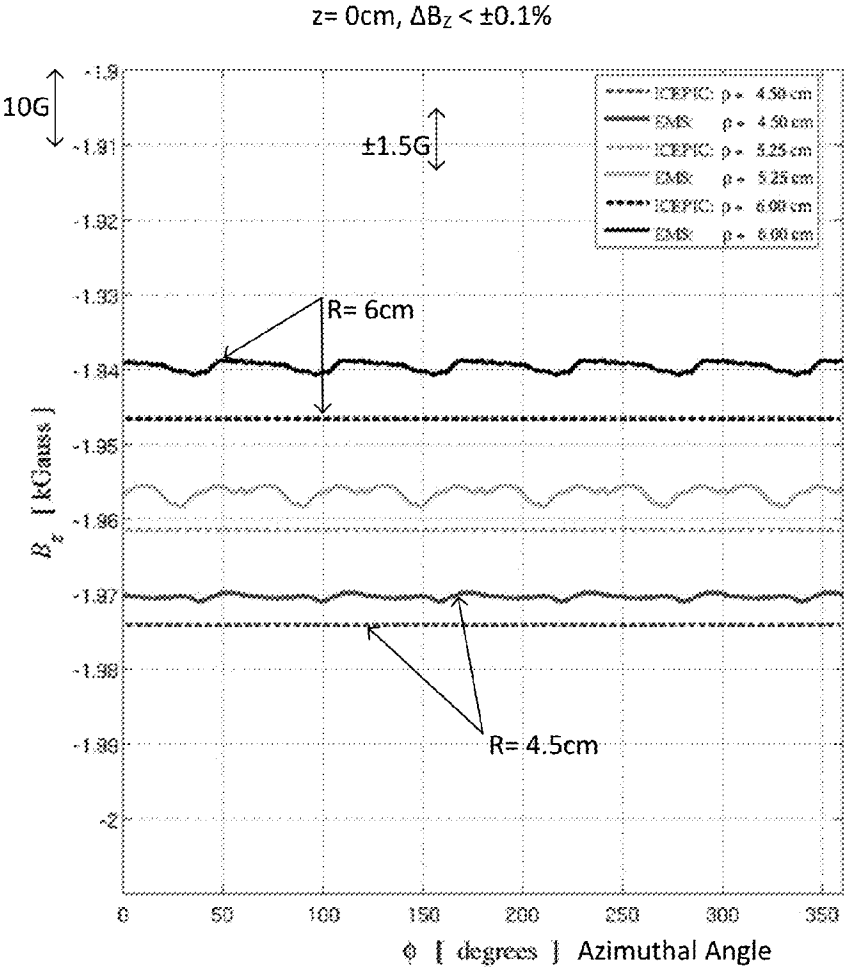
Figure 10:
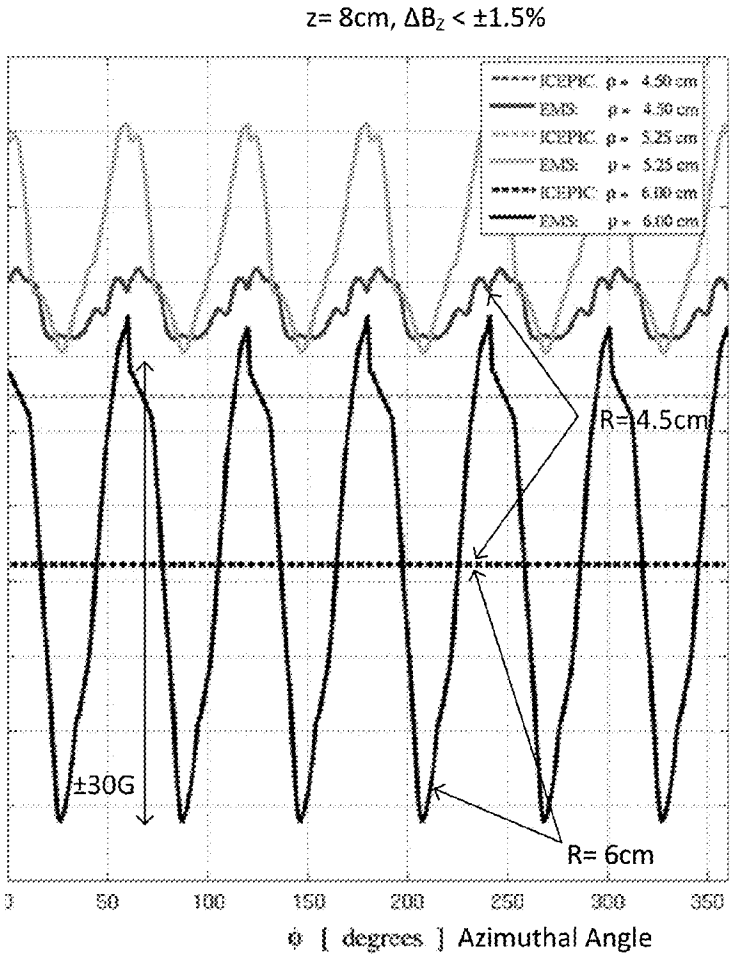

FIGS. 7-10 illustrate results of a magnetic flux density simulation of a compact magnetic field generator for high-power magnetrons according to embodiments of the present disclosure. In FIGS. 7 and 8, the results show that the radial (r) and the axial (Z) components of the magnetostatic fields are highly uniform in the interaction region. More particularly, FIGS. 7 and 8 illustrate the axial variation of a magnetic flux density profile used in ICEPIC simulations of a compact magnetic field generator for high-power magnetrons. In FIG. 7, the x-axis corresponds to the axial position, and the y-axis corresponds to the radial ($B_r$) component of the magnetostatic field of the interaction region. The results reflect the radial ($B_r$) component of the magnetostatic field at a 5.25 cm radial distance from the axis of symmetry. In FIG. 8, the x-axis corresponds to the axial position, and the y-axis corresponds to the axial ($B_Z$) component of the magnetostatic field of the interaction region. In FIGS. 9 and 10, the results show that in the azimuthal angle, the magnetostatic fields are highly uniform in the interaction region. More particularly, FIGS. 9 and 10 illustrate the azimuthal variation in the magnetic flux density for different radii as used in ICEPIC simulations and as predicted by the magnetostatic solver code Electromagnetic Static code (EMS). In FIGS. 9-10, the x-axis corresponds to the azimuthal position or azimuthal angle, and the y-axis corresponds to the axial ($B_Z$) component of the magnetostatic field of the interaction region.

Certain methods of generating the magnetic field required for a high-power microwave source use magnetic field generators that include a large and heavy long solenoid made of permanent magnet material, but the magnetic field generators do not have any access from the side for microwave extraction, do not have trimming rings of permanent magnets to optimize the magnetic profile, do not deliberately use the radial component of the magnetic field to provide axial electron insulation.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means for" or "step for" are explicitly used in the particular claim.

What is claimed is:

1. A compact magnetic field generator for generating a magnetic field within a magnetron, the compact magnetic field generator comprising:
- a plurality of permanent magnets including:
  - a cathode magnet having a longitudinal axis of symmetry and configured to be annularly surrounded by a cathode of the magnetron; and
  - an anode magnet configured to annularly surround an outer perimeter of an anode of the magnetron, and
- wherein an arrangement of the plurality of permanent magnets concentrically about the longitudinal axis of symmetry forms a specified magnetic field within an interaction region that bounds electrons emitted within the interaction region.

2. The compact magnetic field generator of claim 1, wherein the anode magnet is a solid magnet block comprising a hollow cylinder shape concentric with the cathode magnet.

3. The compact magnetic field generator of claim 1, wherein the anode magnet comprises a plurality of annular wedge magnets.

4. The compact magnetic field generator of claim 3, further comprising at least one wedge-shaped waveguide, each wedge-shaped waveguide configured to slidably couple to and between two adjacent annular wedge magnets for radio frequency (RF) wave extraction.

5. The compact magnetic field generator of claim 4, wherein each of the at least one wedge-shaped waveguides is configured to couple to a RF wave extraction port.

6. The compact magnetic field generator of claim 1, wherein the plurality of permanent magnets further comprise:
- a front end cap magnet physically coupled to a front surface of the anode magnet, or
- a back end cap magnet physically coupled to a back surface of the anode magnet, and
- wherein the front and back end cap magnets have a same cross sectional size, shape, and alignment as the anode magnet.

7. The compact magnetic field generator of claim 1, wherein the plurality of permanent magnets further comprise:
- a front ring magnet disposed axially in front of the cathode magnet, or
- a back ring magnet disposed axially behind of the cathode magnet, and
- wherein the front and back ring magnets are configured to be annularly surrounded by the anode magnet.

8. The compact magnetic field generator of claim 1, wherein the specified magnetic field comprises a substantially uniform magnetic flux density throughout an entire axial length of the interaction region.

9. A high-power magnetron assembly comprising:
- a high-power magnetron comprising:
  - a cathode configured to in response to receiving a supply of voltage from a power supply, emit electrons,
  - an anode configured to concentrically surround the cathode and attract the emitted electrons across an interaction region between the cathode and the anode; and a compact magnetic field generator comprising:

a plurality of permanent magnets including:

a cathode magnet disposed within the magnetron, the cathode magnet having a longitudinal axis of symmetry and configured to be annularly surrounded by the cathode; and an anode magnet configured to annularly surround an outer perimeter of the magnetron, and wherein an arrangement of the plurality of permanent magnets concentrically about the longitudinal axis of symmetry forms a specified magnetic field within the interaction region that bounds the electrons emitted within the interaction region.

10. The high-power magnetron assembly of claim 9, wherein the anode magnet is a solid magnet block comprising a hollow cylinder shape concentric with the cathode magnet.

11. The high-power magnetron assembly of claim 9, wherein the anode magnet comprises a plurality of annular wedge magnets.

12. The high-power magnetron assembly of claim 11, further comprising at least one wedge-shaped waveguide, each wedge-shaped waveguide configured to slidably couple to and between two adjacent annular wedge magnets for radio frequency (RF) wave extraction.

13. The high-power magnetron assembly of claim 12, wherein each of the at least one wedge-shaped waveguides is configured to couple to a RF wave extraction port.

14. The high-power magnetron assembly of claim 9, wherein the plurality of permanent magnets further comprise:

a front end cap magnet physically coupled to a front surface of the anode magnet, or a back end cap magnet physically coupled to a back surface of the anode magnet, and wherein the front and back end cap magnets have a same cross sectional size, shape, and alignment as the anode magnet.

15. The high-power magnetron assembly of claim 9, wherein the plurality of permanent magnets further comprise:

a front ring magnet disposed within the magnetron, axially in front of the cathode magnet, or a back ring magnet disposed within the magnetron, axially behind of the cathode magnet, and wherein the front and back ring magnets are configured to be annularly surrounded by the anode magnet.

16. The high-power magnetron assembly of claim 9, wherein the specified magnetic field comprises a substantially uniform magnetic flux density throughout an entire axial length of the interaction region.

17. A method for use with a magnetron including a vacuum vessel, a cathode having a hollow cylinder form, and an anode concentrically surrounding the cathode and configured to attract emitted electrons across an interaction region between the cathode and the anode, where the cathode and the anode are disposed within the vacuum vessel, the method comprising:

creating a high strength magnetic field within the vacuum by:

inserting a cathode magnet within the hollow cylinder of the cathode, where the cathode annularly surrounds the cathode magnet, coupling an anode magnet annularly around an outer perimeter of the anode, and arranging the cathode magnet and the anode magnet concentrically about a longitudinal axis of symmetry of the cathode magnet;

generating an electron flow within the interaction region by:

supplying a source of electrons to the cathode, and attracting the electrons emitted from the cathode toward the anode in a straight radial path across the interaction region between the cathode and the anode;

instituting a twisting motion to the electron flow within the interaction region;

coupling the electron flow to an electromagnetic wave; and, bounding the electron flow within the interaction region; and adjusting a shape of the interaction region, yielding a substantially uniform magnetic flux density throughout an entire axial length of the interaction region.

18. The method of claim 17, wherein coupling an anode magnet annularly around the outer perimeter of the anode comprises direct physical coupling an inner circumferential surface of the anode magnet to an outer surface of the anode, and wherein the anode magnet is:

a solid magnet block comprising a hollow cylinder shape concentric with the cathode magnet, or a plurality of annular wedge magnets.

19. The method of claim 17, further comprising: adjusting a magnetic field intensity of the interaction region by: physically coupling one or more end cap magnets to the anode magnet.

20. The method of claim 17, wherein adjusting a shape of the interaction region further comprises:

adjusting an axial position of one or more ring magnets disposed axially behind or in front of the cathode magnet and annularly surrounded by the anode magnet.

21. The method of claim 17, further comprising selecting a cathode magnet having a shape, size, and radial component of magnitude to provide axial insulation of the electron flow without excessive acceleration of the electron flow in an axial direction, yielding axial confinement.

* * * * *